US005374045A

United States Patent [19]

Milillo

[11] Patent Number: 5,374,045

[45] Date of Patent: Dec. 20, 1994

[54] PRINTING APPARATUS WITH DEFERRED JAM CLEARANCE

[75] Inventor: William D. Milillo, Ontario, N.Y.

[73] Assignee: Xerox Corporation, Stamford, Conn.

[21] Appl. No.: 126,861

[22] Filed: Sep. 27, 1993

[51] Int. Cl.[5] ..... B65H 3/44

[52] U.S. Cl. ..... 271/9; 271/259; 355/313; 355/208

[58] Field of Search ..... 271/9, 259, 265; 355/208, 313, 321

[56] References Cited

U.S. PATENT DOCUMENTS

| | | | |
|---|---|---|---|
| 4,008,957 | 2/1977 | Summers | 355/14 |
| 4,786,042 | 11/1988 | Stemmle | 271/9 |
| 4,800,521 | 1/1989 | Carter et al. | 364/900 |
| 5,096,181 | 3/1992 | Menon et al. | 271/157 |
| 5,157,448 | 10/1992 | Lang | 355/309 |

FOREIGN PATENT DOCUMENTS

| | | | |
|---|---|---|---|
| 0035715 | 3/1980 | Japan | 271/9 |
| 0181651 | 7/1989 | Japan | 271/9 |
| 0075551 | 3/1990 | Japan | 271/9 |
| 0249836 | 10/1990 | Japan | 271/9 |

OTHER PUBLICATIONS

Xerox Disclosure Journal, vol. 9, No. 2, Mar./Apr. 1984, pp. 113-114.

*Primary Examiner*—H. Grant Skaggs
*Assistant Examiner*—Carol L. Druzbick

[57] ABSTRACT

Automatic printing apparatus for printing an image on a sheet including sheet handling apparatus including plural sheet supply means each including a sheet stack support platform, a sheet feeder to feed a sheet from a stack, a sheet transport to transport a sheet from a stack to a first common sheet transport path; a controller to control the operation of the apparatus; at least one sensor to sense the passage of the lead edge of a sheet and to send a signal to the controller when that occurs, at least two of the plural sheet supplies being capable of supplying sheets of the same size, the controller being able to determine the size of the sheet in each sheet supply, the controller responding to the lack of a signal from the at least one sensor within a predetermined time by actuating another sheet supply that has the same size sheet as in the sheet supply from which a sheet was fed but did not reach the sensor within the predetermined time.

16 Claims, 2 Drawing Sheets

PRINTING APPARATUS WITH DEFERRED JAM CLEARANCE

CROSS REFERENCE TO RELATED APPLICATION

Attention is directed to U.S. application Ser. No. 08/093,025, entitled "Auto Paper Size Sensing Mechanism For An Adjustable Cassette", filed Jul. 14, 1993, in the name of Milillo, et al.

BACKGROUND OF THE INVENTION

The present invention relates to automatic sheet handling apparatus wherein if a sheet is misfed from one paper supply tray the machine automatically switches to another tray without interrupting the job by requiring the user to remove the jammed sheet. The sheet can then be removed when the job is completed giving the appearance of higher reliability. It has particular application in automatic printing apparatus such as printers, copiers and other devices, wherein plural sheet supply means are required. More specifically, it has particular application in electrostatographic imaging wherein an image is formed on a sheet, typically paper.

In the process of electrostatographic printing, a photoconductive surface is charged to a substantially uniform potential. The photoconductive surface is imagewise exposed to record an electrostatic latent image corresponding to the informational areas of an original document being reproduced. This records an electrostatic latent image on the photoconductive surface corresponding to the informational areas contained within the original document. Thereafter, a developer material is transported into contact with the electrostatic latent image. Toner particles are attracted from the carrier granules of the developer material onto the latent image. The resultant toner powder image is then transferred from the photoconductive surface to a sheet of support material such as paper and permanently affixed thereto.

This process is well known and useful for light lens copying from an original and in printing applications from electronically generated or stored originals.

Such automatic printing apparatus takes many forms and has many different capabilities. It may have the capacity, for example, to produce less than 5 prints per minute and over 100 prints per minute. It is common practice to have more than one supply of sheets for such a printing apparatus in order to provide prints on stock of varying sizes and types. It is also not uncommon to have more than one sheet supply tray, for example, be supplied with the same size and kind of sheet to provide increased productivity in long printing runs. It is not unusual even in the smaller, lower volume copiers to have the same size and type of paper in all the paper trays. This increases the amount of paper in the machine and gives it the capacity of a high capacity feeder and versatility of also being able to feed different size paper on demand.

One of the most frustrating events for a customer making prints is to have a copier or printer shut down due to paper jams at the feeder and/or post feeder paper transport. The process of having to clear jams and in some machines the entire paper path along with following instructions for job recovery routines including those of the input device can be very annoying. Furthermore, many customers feel uncomfortable with job recovery routines and many times will clear the jam and rerun the entire job completely from the start. The customer perceives this as a machine unreliability issue which can create a situation of great customer dissatisfaction.

PRIOR ART

U.S. Pat. Nos. 4,008,957 to Summers; 5,096,181 to Menon et al.; 5,157,448 to Lang, all assigned to the assignee of the present application and Xerox Disclosure Journal, Volume 9, Number 2, March/April 1984, pages 113–114 describe a load while run function. In the load while run function or mode of operation there are at least two paper supply trays with the same size and type of paper. When one of the trays (i.e. the main tray) is emptied of paper or reaches a low level of paper that is detected by the machine there is an automatic switch over from the empty or low level tray to an auxiliary tray insuring the continuous supply of paper to the printing apparatus. If the same paper stock is not currently loaded in the auxiliary tray the system comes to a stop.

SUMMARY OF THE INVENTION

In accordance with a principle aspect of the present invention an automatic printing apparatus is provided with more than one paper supply tray and in operation if a paper jam should occur at the feeder or the take away roll transport of one of the paper trays, which is usually independent of the common paper path shared by all of the feeders, the machine automatically will switch to another paper supply tray allowing the job to be completed without interruption and customer perceived unreliability.

In a further aspect of the present invention the automatic printing apparatus has a sheet handling apparatus which includes plural sheet supply means each of which has a sheet stack support platform, sheet feed means, means to transport a sheet from the stack to a first common sheet transport path; a controller to control the operation of the apparatus; at least one sensor to sense the passage of the lead edge of a sheet and to send a signal to the controller when that occurs; at least two of the plural sheet supply means being capable of supplying sheets of the same size; means to enable the controller to determine the size of the sheet in each supply means, said controller responding to the lack of a signal from said at least one sensor within a predetermined time by actuating another sheet supply means that has the same size sheet as in the sheet supply means from which a sheet was fed, but did not reach the sensor within said predetermined time.

In a further aspect of the present invention the sensor may be placed in a first common sheet transport path, downstream of the means to feed the sheet from the stack of sheets in the sheet supply means and/or downstream of the means to transport a sheet from the stack to a first common sheet transport path and/or along a sheet bypass path to the first common transport path.

In a further aspect of the present invention plural sheet supply means are provided in a vertical array, one on top of the other and it includes a vertical second common sheet transport path wherein the plural means to transport a sheet to the vertical second sheet transport path to enter the vertical transport path transports sheets at different levels.

In a further aspect of the present invention at least one sensor to sense the passage of the lead edge of a sheet is provided in the vertical second common sheet transport path to send a signal to the controller when that occurs.

In a further aspect of the present invention a sensor is associated with each of the plural sheet supply means to sense the passage of the lead edge of a sheet and to send a signal to the controller when that occurs.

In a further aspect of the present invention a sensor is positioned in the vertical second common sheet transport path between adjacent levels at which a sheet enters said second common sheet transport path from said plural sheet supply means.

In a further aspect of the present invention the sheet supply means includes an adjustable removable cassette with a sheet stack support platform and means to enable the controller to determine the size of the sheet in the cassette.

For a better understanding of the invention as well as other objects and further features thereof, reference is had to the following drawings and descriptions.

DESCRIPTION OF THE PREFERRED EMBODIMENT

The invention will now be described by reference to a preferred embodiment.

Figure 1:
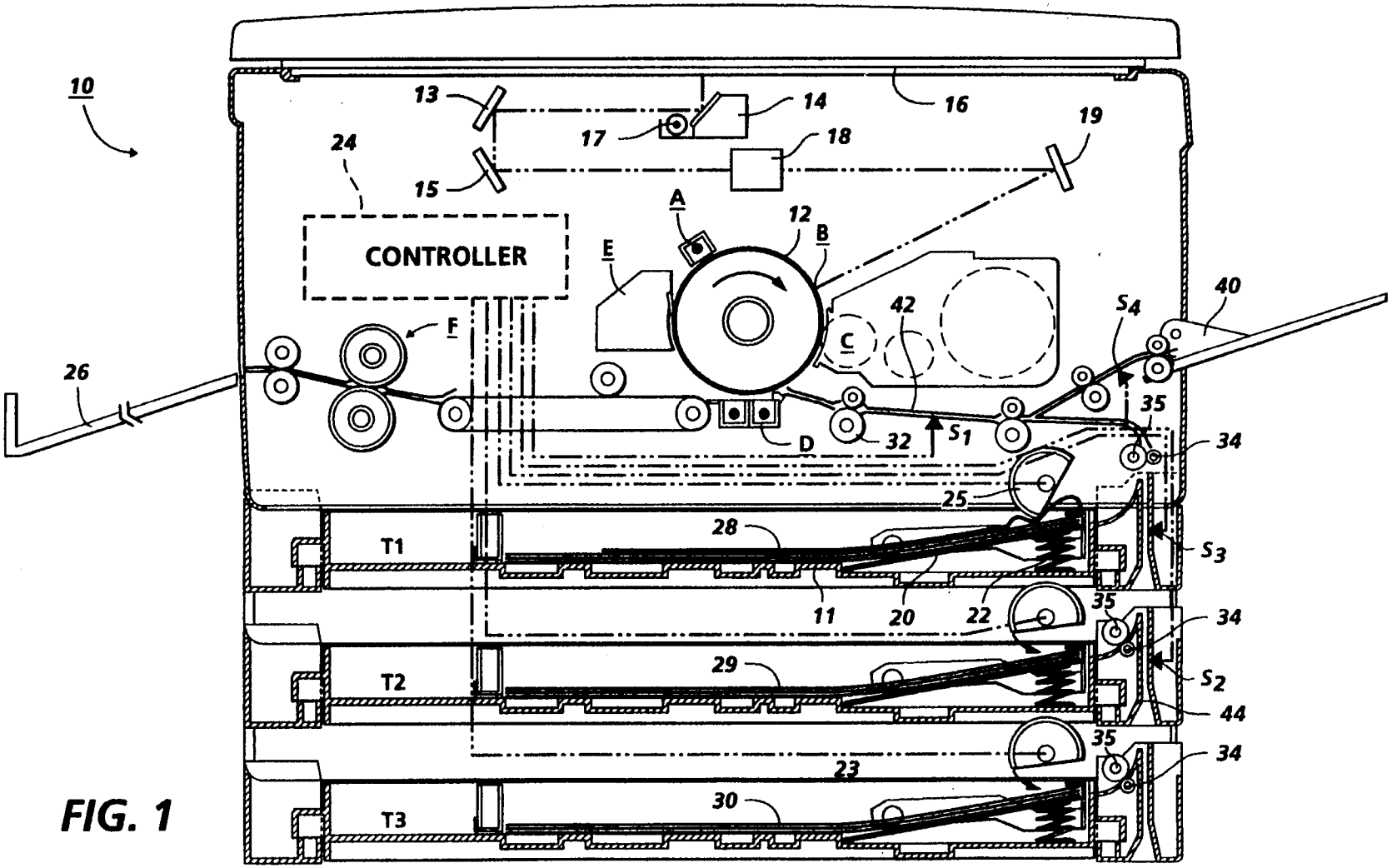
FIG. 1 is a schematic representation of an automatic printing machine having the automatic switching of sheets supply means according to the present invention wherein a sheet is jammed at the sheet feeder of tray $T_1$.
Figure 2:
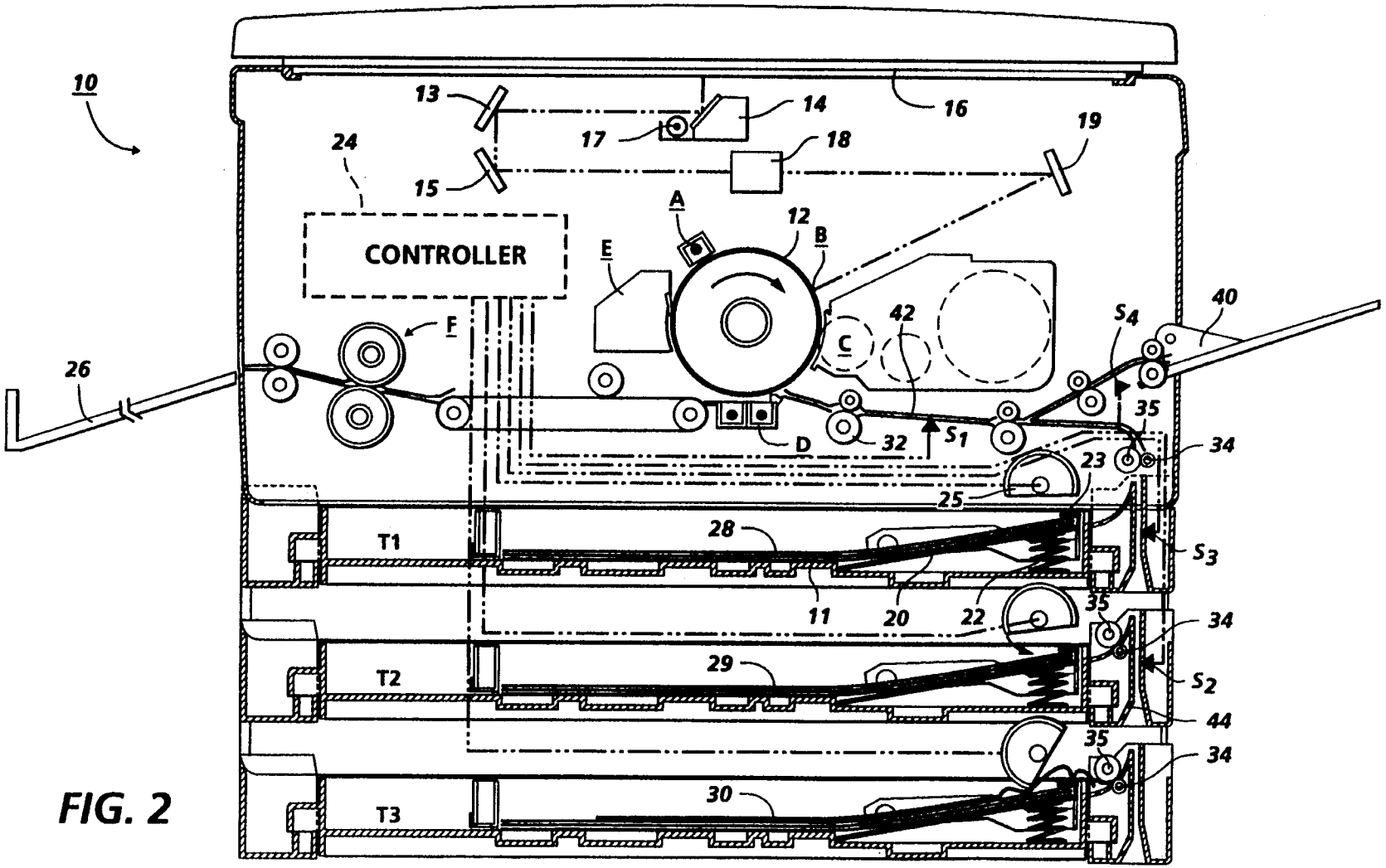
FIG. 2 is a schematic representation of an automatic printing machine having the automatic switching of sheets supply means according to the present invention wherein a sheet is jammed between the feed roll and take away roll of tray $T_3$.

Referring to FIGS. 1 and 2, there is shown an automatic xerographic printing machine 10 including the jam clearance capability according to the present invention. Although the present invention is particularly well suited for use in automatic xerographic apparatus, it is equally well adapted for use with any number of other devices in which cut sheets of material are fed from plural sheet supply sources. The printer includes a photosensitive drum 12 which is rotated in the direction indicated by the arrow to pass sequentially through a series of xerographic processing stations; a charging station A, an imaging station B, a developer station C, a transfer station D and a cleaning station E.

The basic operation of the automatic printing apparatus will be described with reference to a document to be reproduced being placed on imaging platen 16 and scanned by moving optical system 14 including a lamp 17 and mirrors 13 and 15 and lens 18 to produce a flowing light image on the drum surface which had been charged at charging station A. The image is then developed at development station C to form a visible toner image. Three adjustable sheet cassettes 28, 29 and 30 are inserted from the front of the machine into the plane of FIGS. 1 and 2. Since each of the sheet cassettes as illustrated is the same like reference numerals will be used to represent like parts or elements of each cassette. The stack of sheets is supported in each cassette by sheet stack support platform 20 which is urged upwardly by two springs 22 on each side of the front end toward the segmented feed roll 25 and into contact with corner snubber 23. The feeding of sheets is actuated by the controller 24 to feed a sheet from the cassette by actuating segmented sheet feed roll 25 to feed a sheet to registration rolls 32 in synchronous relationship with the image on the drum surface to the transfer station D. Following transfer of the toner image to the copy sheet, the copy sheet is stripped from the drum surface and directed to the fusing station F to fuse the toner image on the copy sheet after which the drum surface itself continues to the cleaning station F where residual toner remaining on the drum surface is removed prior to the drum surface again being charged at charging station A. Upon leaving the fuser, the copy sheet with the fixed toner image thereon is transported to sheet collecting tray 26.

With continued reference to FIGS. 1 and 2 the automatic sheet handling apparatus and it's use in deferring jam clearance situations will be described in greater detail. The sheet handling apparatus includes plural sheet supply means at least two of which are capable of supplying sheets of the same size. As illustrated, the sheet supply means are three adjustable sheet cassettes, 28, 29 and 30, having the same configuration including a sheet stack support platform, a spring to bias the flat forward end of the platform upwardly into snubbers 23. The sheet supply means includes means to feed a sheet here illustrated as a top sheet feeder in the form of a segmented roll 25, although it will be understood that other types of sheet feeding devices, such as, for example, friction retard devices may also be used. The means to transport a sheet to either the first or second common sheet transport path comprises a pair of take away rolls 34, 35, one of which is rotatably driven to form a sheet transporting nip. While the sheet feed roll and the take away rolls may be part of the sheet cassette or tray it is preferred that they be part of the main body of the machine as this simplifies the drives and does not require electrical connections in the cassette. Furthermore, with the take away rolls located on the main body of the machine it reduces the number of nips in the machine due to maximum allowable nip spacing for reliable paper feeding. If the take away rolls were in the cassette, a second nip would still be necessary in the main body for each cassette.

The sheet transport path comprises two portions, a generally horizontal first common sheet transport path 42, generally from the take away roll associated with the top tray, $T_1$, to the transfer station D, and a second vertically oriented common transport path 44 from the take away roll pair associated with tray $T_3$ through to the take away roll pair associated with tray $T_1$.

The automatic printing apparatus has a controller to control the operation of the machine. Any suitable controller that is capable of contributing to the successful operation of electrostatographic printing machine may be employed for this purpose. A particularly useful one is the controller described in U.S. Pat. No. 4,800,521 to Carter et al. which is hereby incorporated in it's entirety by reference. The controller may determine the size of a sheet in any particular sheet supply tray by the operator manually indicating the size for each sheet supply tray on the control panel in the machine. This is readily accomplished by having trays $T_1$, $T_2$, $T_3$, etc., together with actuating control buttons for different sizes of sheets associated with each tray which the operator can push or engage to enable the controller to determine the sheet size in each tray. However, it is preferred that each of the individual trays or cassettes have means to enable the controller to determine the size of the sheet in each tray. In this regard attention is directed to the above cross-referenced copending application. Briefly, this copending application describes an adjustable sheet cassette which is movable in an automatic printing apparatus from a sheet feeding position to a nonsheet feeding position which has a sheet stack support platform capable of supporting stacks of sheets of a plurality of length and width dimensions, at least one sheet edge guide movable in a path in the cassette to accommodate stacks of sheets of different length and width dimensions, the sheet edge guide having attached thereto an actuator arm having a plurality of switch actuators for selectively actuating a plurality of switches on a circuit board on the main body of the apparatus when the cassette is in sheet feeding position in the apparatus, the actuator being located to selectively actuate the switches on the main body of the apparatus which represents one of a plurality of sheet sizes whereby when each of the switches is actuated it generates a unique resistance in the circuit on the circuit board, the resultant of these unique resistances determine a resultant voltage signal to the main controller on the main body of the apparatus which allows the controller to interpret the length or width dimension of the sheets in the sheet cassette. For further details, attention is directed to the complete disclosure above reference copending application. Alternatively, the adjustable size sensing sheet cassette and system described in U.S. Pat. No. 4,786,042 to Stemmle may be used.

Any suitable sensor may be used to sense the passage of the lead edge of the sheet passed it and to send a signal to the controller when that event occurs. Typical sensors include reflective and transmissive optical sensors or switches, and mechanically actuated switches which are preferred due to their lower cost and lesser sensitivity to contamination.

With reference to FIG. 1, a sensor $S_1$ will sense the passage of the lead edge of a sheet being fed from, for example, tray $T_3$. Since all of the individual operations in the process of forming a print are controlled by the controller, if the sensor does not sense the passage of the lead edge of a sheet and send the signal to that effect to the controller within a predetermined time, the controller is programmed to respond to the lack of a signal from the sensor to actuate another sheet supply that has a same size sheet. Thus, for example, if in the running of a particular printing job tray $T_3$ was initially selected to supply the sheets and the sheet was fed from tray $T_3$ and a jam formed either at the sheet feed means 25 or at the take away rolls 34/35 that the sheet did not reach the sensor $S_1$ within the predetermined time, the controller which already knows that the same size sheet in tray $T_3$ is also in tray $T_1$ would automatically actuate tray $T_1$ to feed a sheet. Naturally when this condition exists, a delay automatically is formed between the feeding of the second sheet from tray $T_1$ add if imaging were continued lead edge registration of the image on the drum 12 and the copy sheet would be completely destroyed. Accordingly, when this condition exists a pitch is lost in the imaging cycle in that the imaging member continues to rotate around one revolution being cleaned of the first toner image, recharged, re-exposed and redeveloped, so that it reaches the transfer station D in registration with the sheet fed from tray $T_1$. While FIG. 1 and 2 illustrate only sensors, $S_1$, $S_2$ and $S_3$ for the sake of simplicity in illustration, it should be noted that sensors may be placed in various positions in the individual sheet supply means or tray as well as in both the common sheet transport paths. For example, if desired they may be placed downstream of the sheet feed means or downstream of the sheet transport to the common sheet transport path such as the take away rolls. As illustrated, the apparatus also includes a sheet bypass feeder 40 and a sensor $S_4$ may also be placed in that sheet feeding path downstream of the transport rolls.

Further, as illustrated in FIGS. 1 and 2 the sheet transport or take away rolls transport a sheet to the vertical second sheet transport to enter the vertical sheet transport at different levels. As illustrated in FIGS. 1 and 2, sensors $S_2$ and $S_3$ are positioned in the vertical second common sheet transport path between adjacent levels at which a sheet enters the vertical second common sheet transport path from the plural sheet supply tray, $T_2$ and $T_3$. This provides a sensor being positioned in the vertical second common sheet transport path between the level at which a sheet entering said the common sheet transport path from the bottom of sheet supply tray and the level at which a sheet enters the common sheet transport path from the next highest sheet supply tray. In operation, the means to feed a sheet from the stack and the means to transport the sheet from the stack to a common sheet transport path are usually independent of the rest of the paper path which is shared by all the feeders. If in FIGS. 1 and 2 a jam of a sheet being fed from tray $T_3$ is formed at the sheet feeder or the take away rolls this is not in the common path, so that if the same size sheet as in tray $T_3$ is in either of trays $T_1$ or $T_2$ it may be fed to the processor. Thus, if the sheet is jammed at take away rolls for tray $T_3$ it does not interfere with the paper path from tray $T_2$ or from tray $T_1$. Further, if the jam is at the take away roll, for example, at tray $T_2$, this does not interfere with the paper path from tray $T_1$. Accordingly, it is preferable that the first possible jam occurrence would be one to occur in the lowest paper supply tray, the sheet handling apparatus would have the opportunity to continue to feed sheets from a higher positioned tray. However, it is not necessary to make the first feed from the bottom most, since, if a jam does occur and it is not in the common path the controller can automatically actuate any one of the other trays.

Thus, according to the present invention should a paper jam occur at the feeder or take away roll transport the printing apparatus will automatically switch to another paper supply allowing the job to be completed without interruption and subsequent customer dissatisfaction. Indeed, the customer will perceive an increased reliability in machine operation. In addition, important time may be saved in that the running of a particular printing job will not have to be stopped in the middle and not have to go through a job recovery program and one may not have to run the job all over again. Furthermore, leaving the jam in it's own location in most machine architectures and switching to a different sheet supply will not present a problem since the drives and the feeder and take away roll location are only operative when that particular feeder is being used. When a jam occurs a display on the control panel will indicate that a sheet jam in the paper supply has occurred and it's location. The current operator or subsequent operators can then clear the jam at the end of the job or at the beginning of the next job or at their own discretion.

The patents and text referred to specifically in this application are hereby incorporated herein by reference in their entirety in to the present application.

Thus, according to the present invention a printing apparatus with deferred jam clearance is provided. Furthermore, while the invention has been described with regard to electrostatographic printing apparatus, it will be understood that it has equal application to other types of printing and sheet handling devices. Furthermore, while the invention has been described with reference to a copier it has equal application to other machines such as printers where the image is electronically generated. Accordingly, it is intended to embrace all such alternatives and modifications as may fall within the spirit and scope of the appending claims.

I claim:

1. An automatic printing apparatus including an imaging member, means for printing an image on a sheet, sheet handling apparatus including plural sheet supply means each including a sheet stack support platform, means to feed a sheet from a stack, means to transport a sheet from a stack to a first common sheet transport path; a controller to control the apparatus including the imaging cycle of the imaging member;

at least one sensor to sense the passage of the lead edge of a sheet and to send a signal to said controller when that occurs, at least two of said plural sheet supply means being capable of supplying sheets of the same size, means to enable the controller to determine the size of the sheet in each sheet supply means;

said controller responding to the lack of a signal from said at least one sensor within a predetermined time by losing a pitch in the imaging cycle of the imaging member and actuating another sheet supply means that has the same size sheet as in the sheet supply means from which a sheet was fed but did not reach the sensor within said predetermined time.

2. The printing apparatus of claim 1 wherein said at least one sensor is in said first common sheet transport path.

3. The printing apparatus of claim 1 wherein said at least one sensor is downstream of said means to feed a sheet from a stack in at least one of said plural sheet supply means.

4. The printing apparatus of claim 1 wherein said at least one sensor is downstream of said means to transport a sheet from a stack to a first common sheet transport path.

5. The printing apparatus of claim 1 wherein said means to feed a sheet from a stack is a top sheet feeder.

6. The printing apparatus of claim 5 wherein said top sheet feeder is a segmented feed roll.

7. The printing apparatus of claim 1 wherein said means to transport a sheet from a stack to a first common sheet transport comprises a pair of take away rolls, one of which is rotatably driven to form a sheet transport nip.

8. The printing apparatus of claim 1 further including bypass sheet supply means to feed sheets along a sheet bypass path to said first common transport path.

9. The printing apparatus of claim 8 including a sensor to sense the passage of a sheet from said bypass sheet supply means toward said first common transport path and to send a signal to said controller when that occurs.

10. The printing apparatus of claim 1 wherein plural sheet supply means includes plural sheet supply means in a vertical array one on top of the other.

11. The printing apparatus of claim 10 including a vertical second common sheet transport path and wherein said plural sheet supply means includes means to transport a sheet to said vertical second common sheet transport path to transport sheets to enter said vertical second transport path at different levels.

12. The printing apparatus of claim 11 wherein a sensor is associated with each of said plural sheet supply means to sense the passage of the lead edge of a sheet and to send a signal to said controller when that occurs.

13. The printing apparatus of claim 11 including at least one sensor to sense the passage of the lead edge of a sheet in said vertical second common sheet transport path and to send a signal to said controller when that occurs.

14. The printing apparatus of claim 13 wherein a sensor is positioned in said vertical second common sheet transport path between the level at which a sheet entering said vertical second common sheet transport path from the bottom most sheet supply means and the level at which a sheet enters said common sheet transport path from the next highest sheet supply means.

15. The printing apparatus of claim 13 wherein a sensor is positioned in said vertical second common sheet transport path between adjacent levels at which a sheet enters said second common sheet transport path from said plural sheet supply means.

16. The printing apparatus of claim 1 wherein each of said plural sheet supply means comprises on adjustable removable cassette with a sheet stock support platform.

* * * * *